US005486114A

United States Patent [19]

Soes et al.

[11] Patent Number: 5,486,114

[45] Date of Patent: Jan. 23, 1996

[54] MOTHER BOARD-TO-DAUGHTER BOARD ELASTOMERIC ELECTRICAL CONNECTOR

[75] Inventors: Lucas Soes, Rosmalen; Hermann P. J. Gilissen, Esch, both of Netherlands

[73] Assignee: The Whitaker Corporation, Wilmington, Del.

[21] Appl. No.: 194,439

[22] Filed: Feb. 10, 1994

[30] Foreign Application Priority Data

Feb. 22, 1993 [GB] United Kingdom ..... 9303533

[51] Int. Cl.[6] ..... H01R 9/09

[52] U.S. Cl. ..... 439/62; 439/326; 439/67

[58] Field of Search ..... 439/59, 62, 325, 439/326, 327, 329, 66, 67, 629, 630

[56] References Cited

U.S. PATENT DOCUMENTS

| | | | |
|---|---|---|---|
| 4,693,529 | 9/1987 | Stillie | 439/67 |
| 4,881,901 | 11/1989 | Mendenhall et al. | 439/629 X |
| 4,894,022 | 1/1990 | Guckenheimer | 439/327 X |
| 5,205,739 | 4/1993 | Malo et al. | 439/66 |
| 5,248,262 | 9/1993 | Busacco et al. | 439/67 X |

*Primary Examiner*—Khiem Nguyen

*Attorney, Agent, or Firm*—Eric J. Groen; Driscoll A. Nina

[57] ABSTRACT

A mother board-to-daughter-board electrical connector comprises a metal housing having mounting feet for securing it to a mother circuit board, and a rocker assembly consisting of an elastomeric electrical connector element and a metal spring support fixed together in internested relationship. The connector element has an upright arm and a transverse arm, a first node projecting from the upright arm and a second node projecting from the transverse arm. Printed conductors on the connector element have contact surfaces extending over the nodes. The metal support has trunnions which engage in circular openings in side plates of the housing. The daughter circuit board can be inserted into the housing in a vertical, pre-loaded position and can be tilted towards the rocker assembly so as to be latched thereagainst by latching tongues on the housing, in a connecting position, in which conductors on the daughter board engage respective ones of the contact surfaces on the first node. The contact surfaces on the second node engage the conductors on the mother board. As the daughter board is tilted to its connecting position, the rocker assembly is tilted in the same direction against the resilient action of the spring support whereby contact surfaces on the first node are spring loaded against the conductors of the daughter board.

10 Claims, 12 Drawing Sheets

MOTHER BOARD-TO-DAUGHTER BOARD ELASTOMERIC ELECTRICAL CONNECTOR

BACKGROUND OF THE INVENTION

1. Field of the Invention

This invention relates to an elastomeric electrical connector before connecting conductors on a daughter circuit board to respective conductors on a mother circuit board.

2. Description of the Prior Art

There is disclosed in U.S. Pat. No. 4,693,529, an electrical connector for inter connecting first conductors on a mother circuit board to respective second conductors on a daughter circuit board, the connector comprising; an elastomeric connector element having first and second substantially orthogonally projecting nodes and third conductors each having a first contact circuit on the first node and a second contact surface on the second node; and a housing receiving the connector element, the housing having means for securing it to the mother board with the second contact surfaces engaging respective ones of the first conductors, and means for latching the daughter board to the housing in a latched position with the first contact surfaces engaging respective ones of the second conductors.

A disadvantage of using an elastomeric element for supporting the third conductors is that, in time, the elastomeric material of the connector element tends to set thereby impairing the electrical connection between the conductors of the mother and daughter circuit boards.

SUMMARY OF THE INVENTION

According, therefore, to the present invention, an electrical connector as defined in the second paragraph of this specification is characterized in that the elastomeric connector element is mounted in the housing on a spring support so as to be rockable against the action thereof by the act of latching the daughter board to the housing, whereby in the latched position of the daughter board the first contact surfaces are spring loaded by said spring support against the second conductors.

Thus, the first contact surfaces will follow the set of the elastomeric material of the connector element, should such set occur over the passage of time.

The spring support is preferably L-shaped, the elastomeric connector element also being L-shaped and being internested in the spring support.

The third conductors are preferably printed on to the elastomeric material of the elastomeric connector element.

According to the embodiment described herein, the elastomeric connector element is fixed, for example by means of an adhesive, to the spring support, the spring support being rockable about pivot means comprising part circular trunnions projecting from opposite ends of the support and being rotatably received in respective holes in opposite side walls of the housing. The end edges of each trunnion define a slot into which projects a spur in the housing thereby limiting the rocking movement of the elastomeric connector element. The angular position of the connector element and the spring support is thereby controlled as the connector is being assembled to the mother board and during insertion of the daughter board into the housing.

The nodes, and thus the first and second contact surfaces of the elastomeric connector element are preferably smoothly arcuate so that by virtue of the rocking action of the connector element, the first contact surfaces wipe against the conductors of the daughter board and the second contact surfaces of the connector element wipe against the conductors of the mother board. Thus oxide or other fouling is wiped from the contact surfaces of the connector element and those of the board conductors as the daughter board approaches its latched position.

The daughter board may be fixed in its latched position between latching tongues on the housing and an inclined flap projecting from a wall of the housing.

The terms mother board and daughter board as used herein include circuit cards and other substantially rigid substrates having conductors provided thereon by printing or by other means.

DETAILED DESCRIPTION OF THE PREFERRED EMBODIMENT

Figure 10:
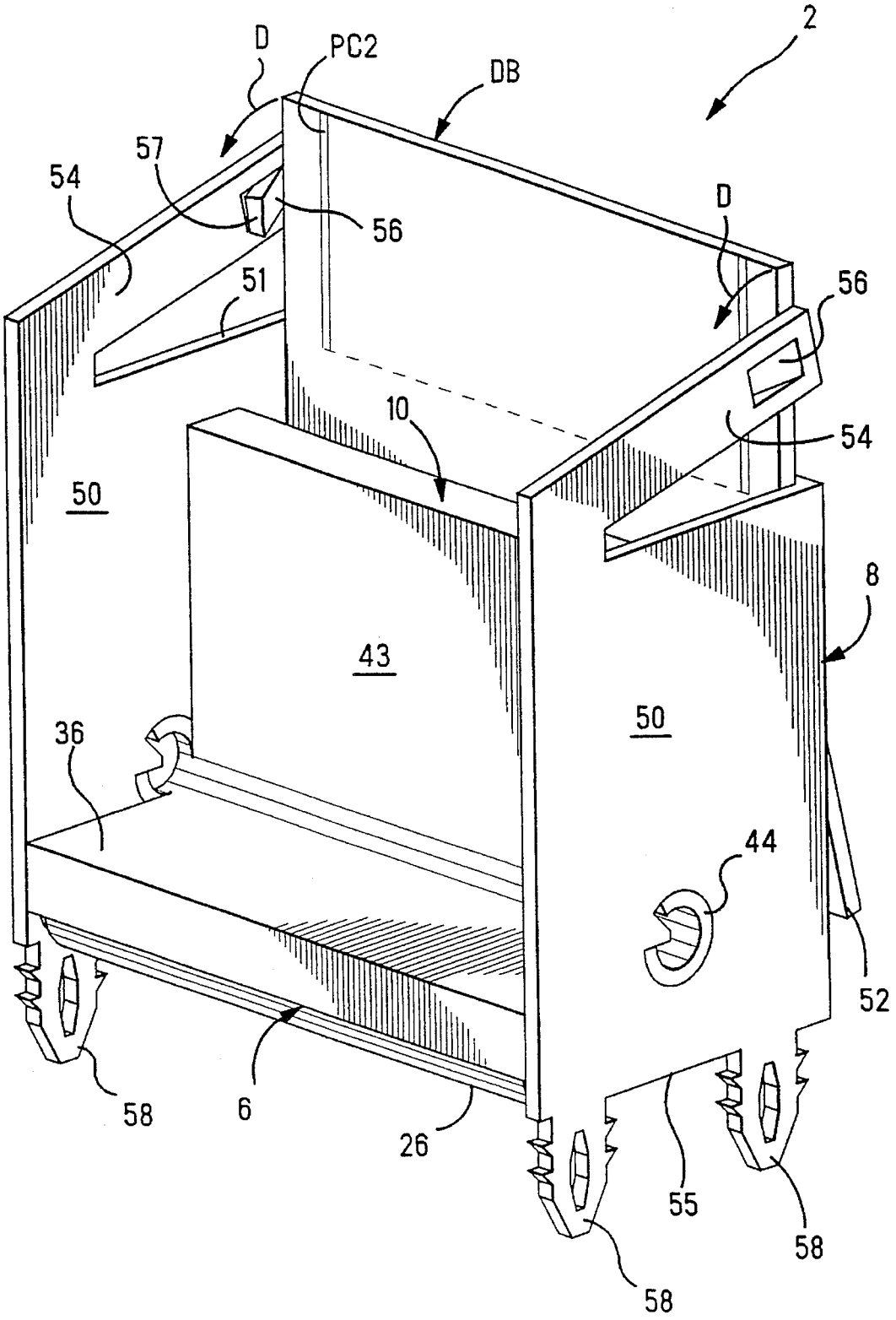
FIG. 10 is a rear isometric view of the mother board-to-daughter board connector with the daughter board inserted therein in a preloaded position.
Figure 11:
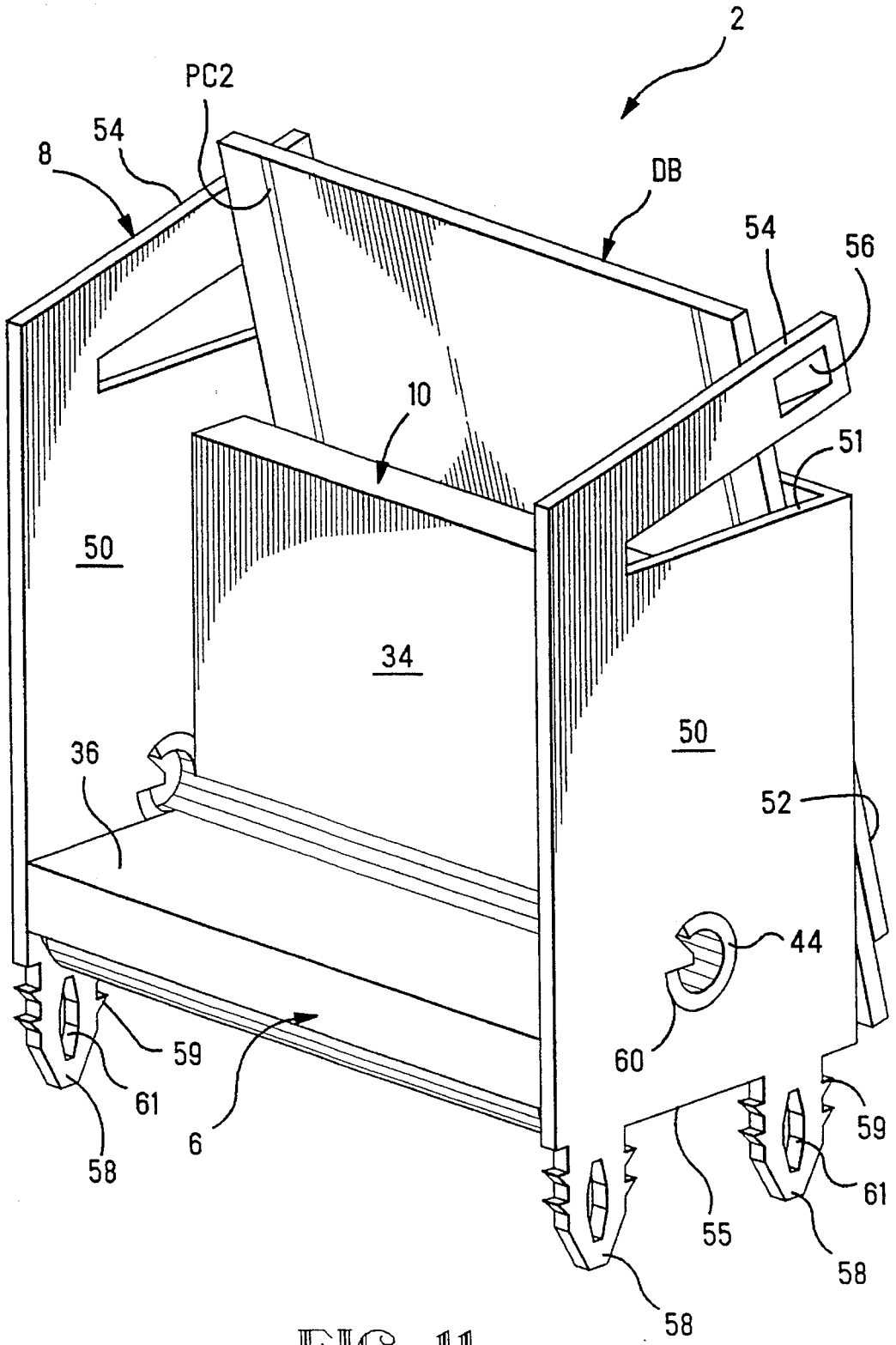
FIG. 11 is a rear isometric view of the mother board to daughter board connector showing the daughter board therein in a latched, connected position.

The mother board-to-daughter board electrical connector 2 (FIGS. 6 and 8 to 12) for mounting on a mother board MB (FIG. 12) having a row of printed conductors PC1 thereon connected to circuitry (not shown) thereon, comprises an elastomeric electrical connector element 4 (FIGS. 1, 3, 4, 8 and 9) a metal spring support 6 (FIGS. 2 to 4, 6 and 8 to 11) for the connector element 4 and a metal housing 8 (FIGS. 5, 6 and 8 to 12) for a rocker assembly 10 (FIGS. 3, 4, 6 and 9 to 11) consisting of the connector element 4 fixed to the spring support. 6. A daughter board DB has, as shown in FIG. 6, 10 and 11, a row of printed conductors PC2 thereon connected to circuitry (not shown) on the board DB. The connector 2 is for connecting respective conductors PC2 on the daughter board DB to respective conductors PC1 on the mother board MB. The daughter board DB may, for example, be a single in-line memory module.

Figure 1:
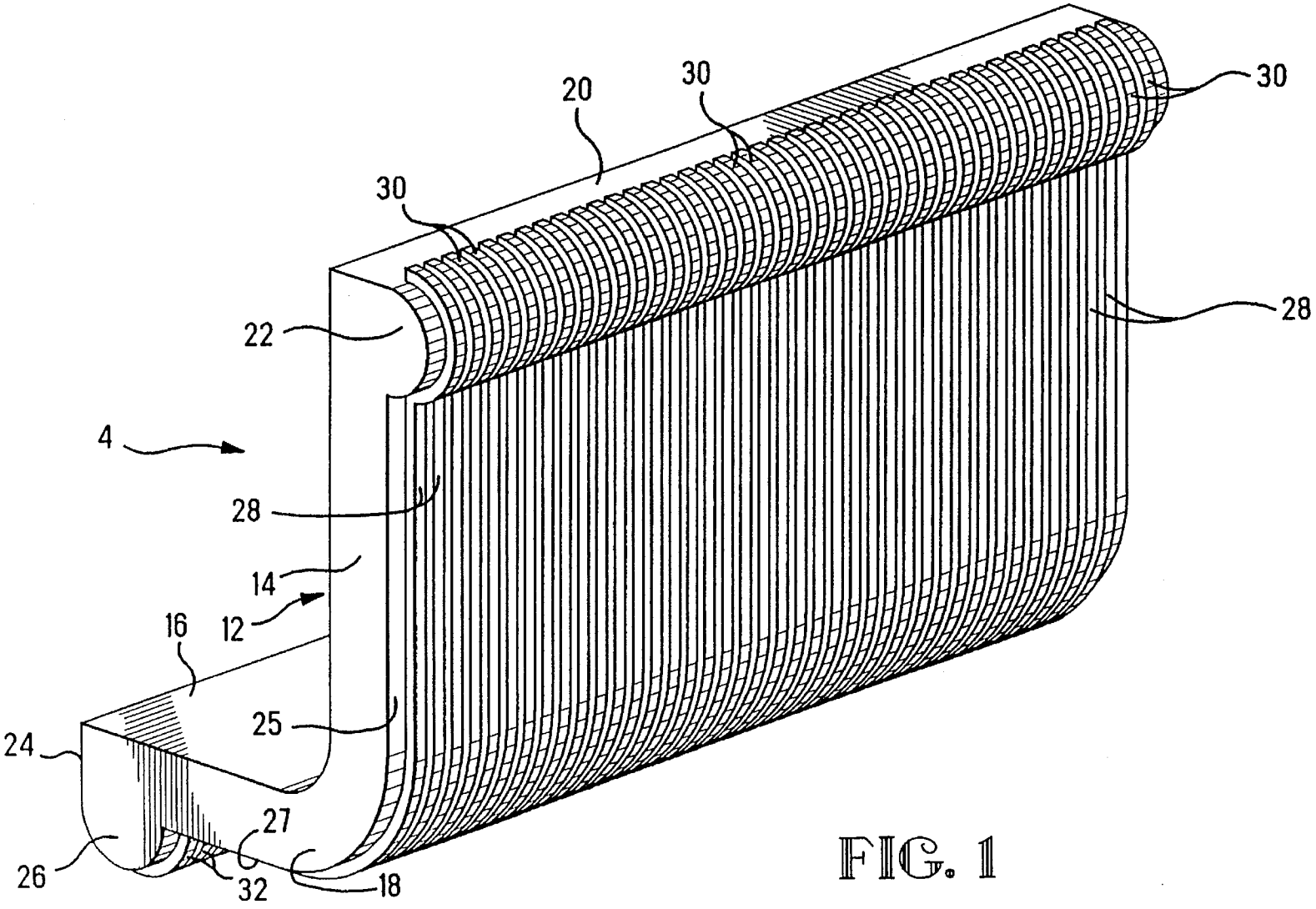
FIG. 1 is an enlarged, front isometric view of an end portion of an elastomeric, mother-board-to daughter board, electrical connector element having printed conductors thereon.
Figure 2:
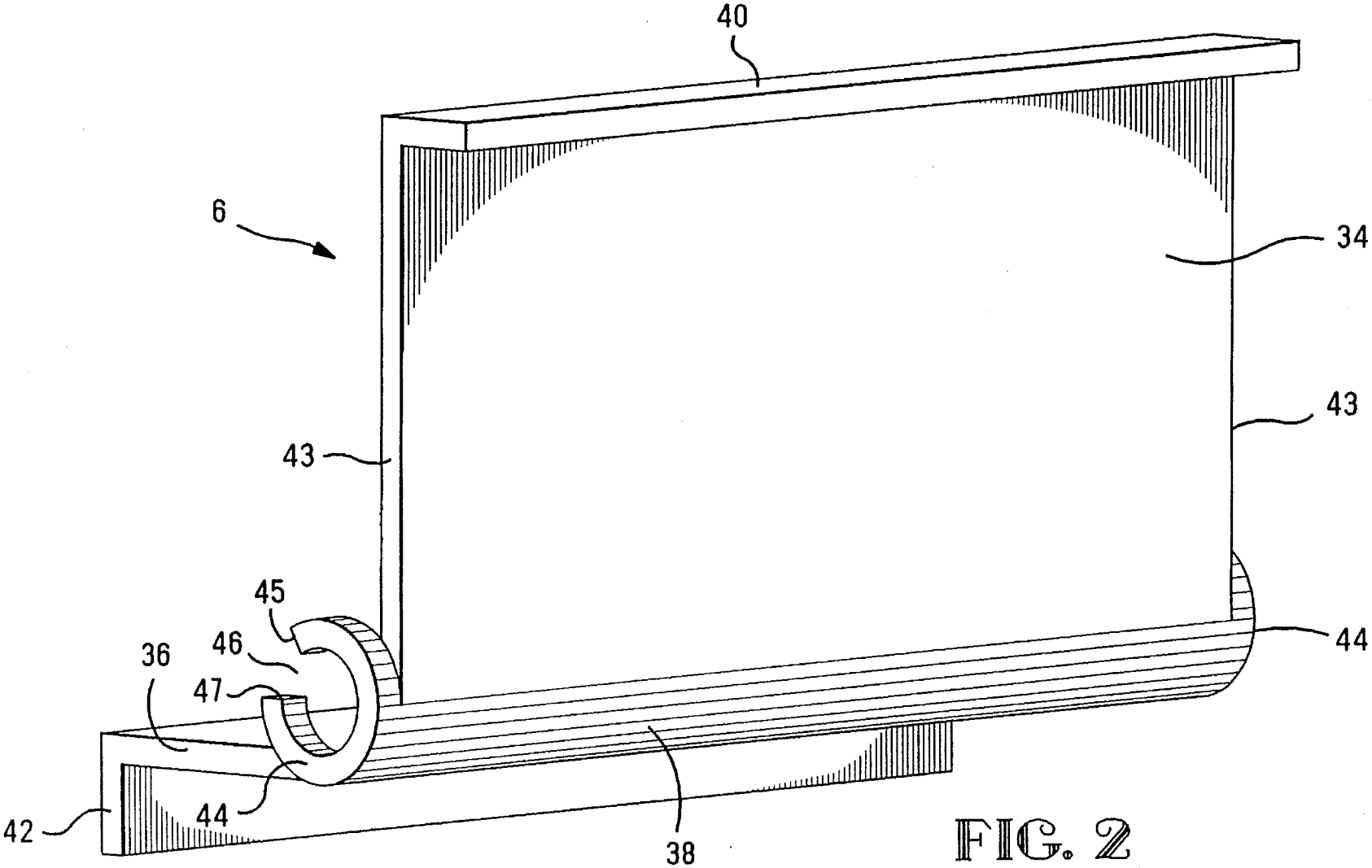
FIG. 2 is a front isometric view of a metal spring support for the elastomeric connector element.

As best seen in FIG. 1, the elastomeric connector element 4 comprises an elongate, substantially L-cross section, one piece elastomeric body 12 consisting of an upright arm 14 and a rearward transverse arm 16 connected to the arm 14 by way of a bight 18 and extending at right angles to the arm 14. The upright arm 14 is substantially planar excepting that proximate to its free top edge 20, remote from the bight it 18 is formed with a forwardly convex, smoothly arcuate first node 22 which extends along the full length of the arm 14. The arm 16 is also substantially planar excepting that proximate to its rear edge 24 it is formed with a downwardly convex second node 26 which projects orthogonally with respect to the node 22. The forward and lower faces 25 and 27, respectively, of the elastomeric body 12 have printed thereon a longitudinally extending row of metal conductors 28. Each conductor 28 extends from the top edge 20, over the first node 22 to provide a first forwardly bowed, smoothly arcuate contact surface 30. From the surface 30, each conductor 28 extends down the upright arm 14, over the bight 18, across the lower face 27 of the arm 16 and over the second node 26 to provide a second contact surface 32 which is downwardly bowed and is smoothly arcuate.

The metal spring support 6 which has been stamped and formed from a single piece of spring metal stock, comprises an upright, forward support plate 34 and a rearward, transverse support plate 36 extending at right angles to the plate 34. The plates 34 and 36 are connected by a bight 38. There projects forwardly from the top edge of the plate 34, along its full length, and at right angles to the plate 34, a planar flange 40. A further planar flange 42 projects from the rear edge of the plate 36, downwardly and at right angles thereto. At each end of the spring support 6, there projects from a respective end edge 43 of the support 6, at the bight 38, a part circular spring trunnion 44. The trunnion 44 has been stamped and formed with the remainder of the support 6 and is accordingly formed integrally therewith. Each trunnion 44 defines a rearward slot 46 in its periphery, above the support plate 36, the slot 46 being defined by an upper edge 45 and a lower edge 47, as best seen in FIG. 7.

Figure 3:
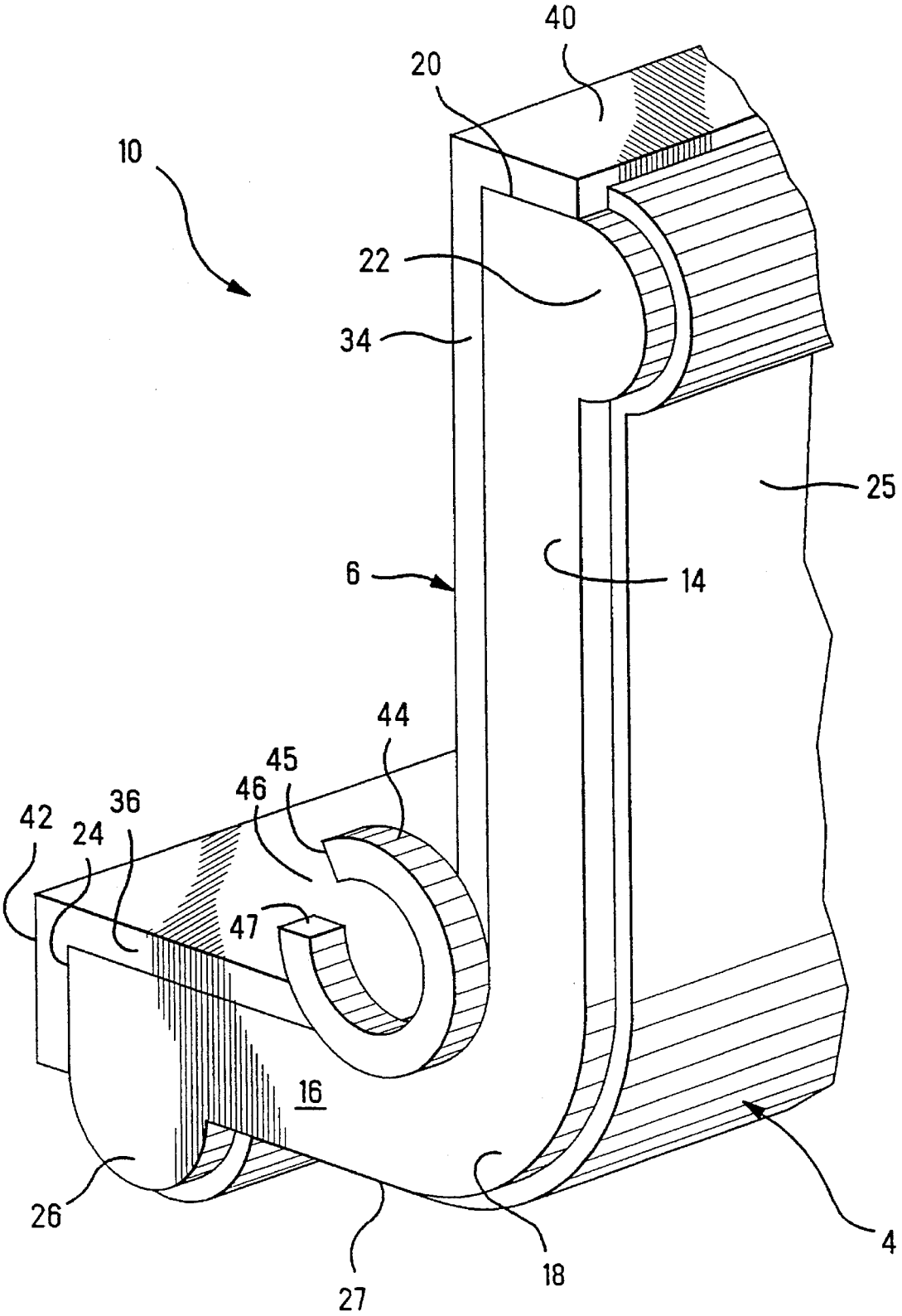
FIG. 3 is an enlarged front isometric view of an end portion of a rocker assembly comprising the elastomeric connector element fixed to the spring support, the printed conductors of the connector element not being shown.
Figure 4:
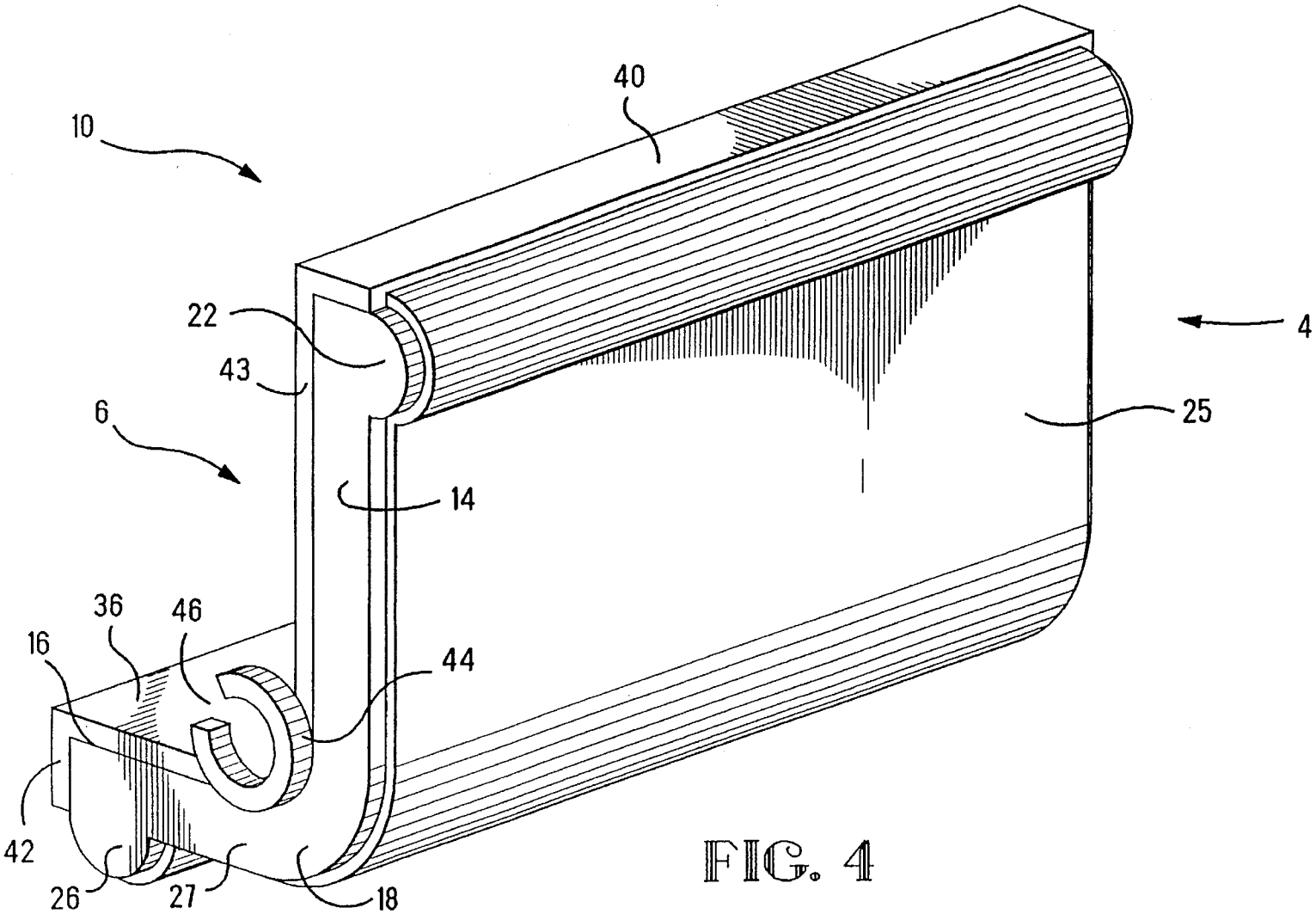
FIG. 4 is a front isometric view of the rocker assembly, the printed conductors of the connector element not being shown.

In order to provide the rocker assembly 10, the connector element 4 is assembled to the support 6, as best seen in FIGS. 3 and 4. In order to fix the elastomeric connector element 4 and the spring support 6 together, in internested relationship, the top edge 20 of the upright arm 14 of the element 4 is secured by means, for example, of an adhesive to the underside of the flange 40 of the support 6, the rear face of the upright arm 14 is secured to the forward face of the plate 34 of the support 6 by means, for example, of the adhesive, the upper face of the arm 16 of the element 4 is fixed to the underside of the plate 36 of the support 6 by means, for example, of the adhesive and the rear edge 24 of the arm 16 of the element 4 is fixed to the forward face of the flange 42 of the plate 36 by means, for example, of the adhesive.

Figure 5:
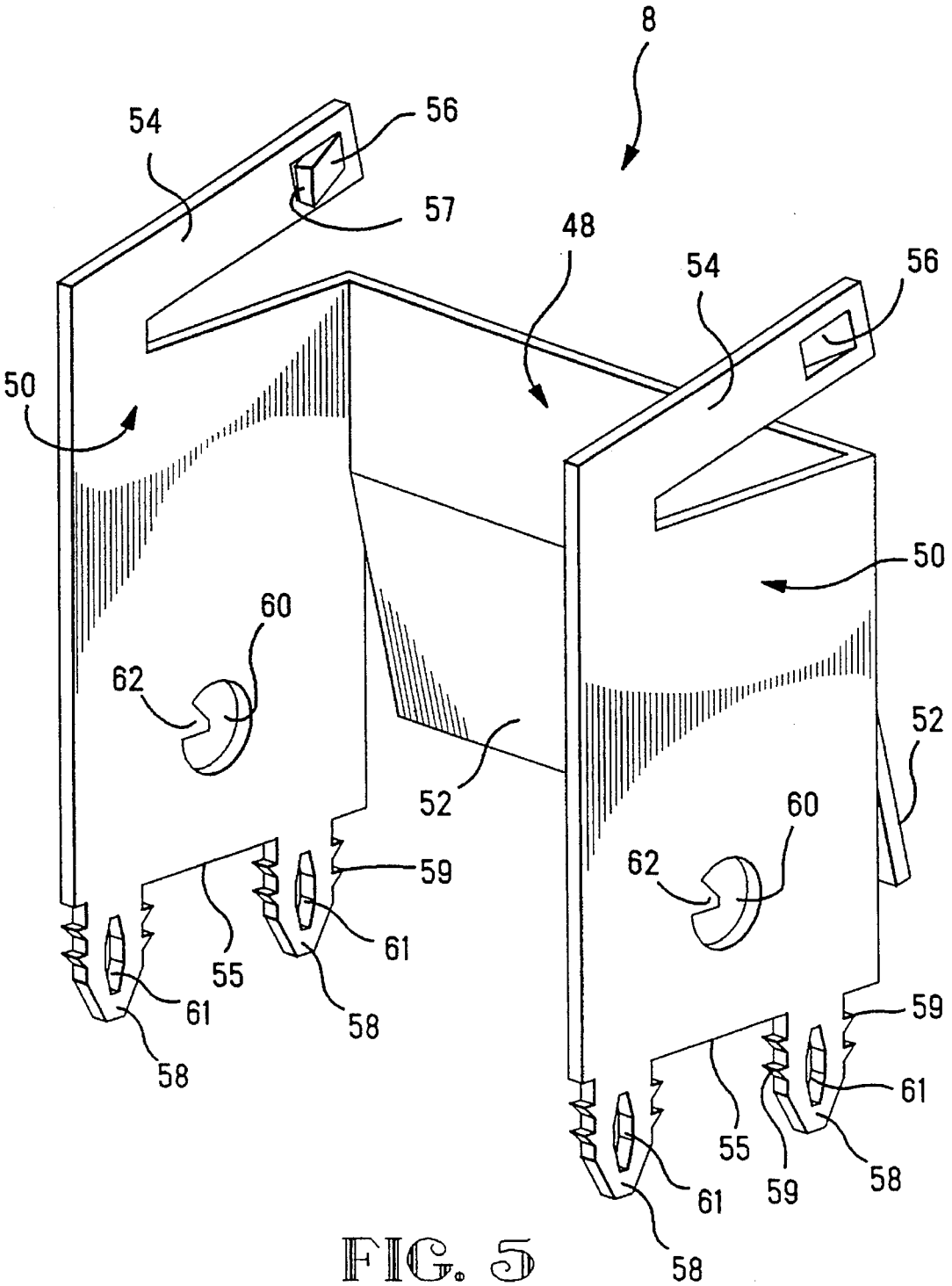
FIG. 5 is a rear isometric view of a metal housing for receiving the rocker assembly for pivotal movement therein, thereby to provide a mother board to daughter board electrical connector.
Figure 6:
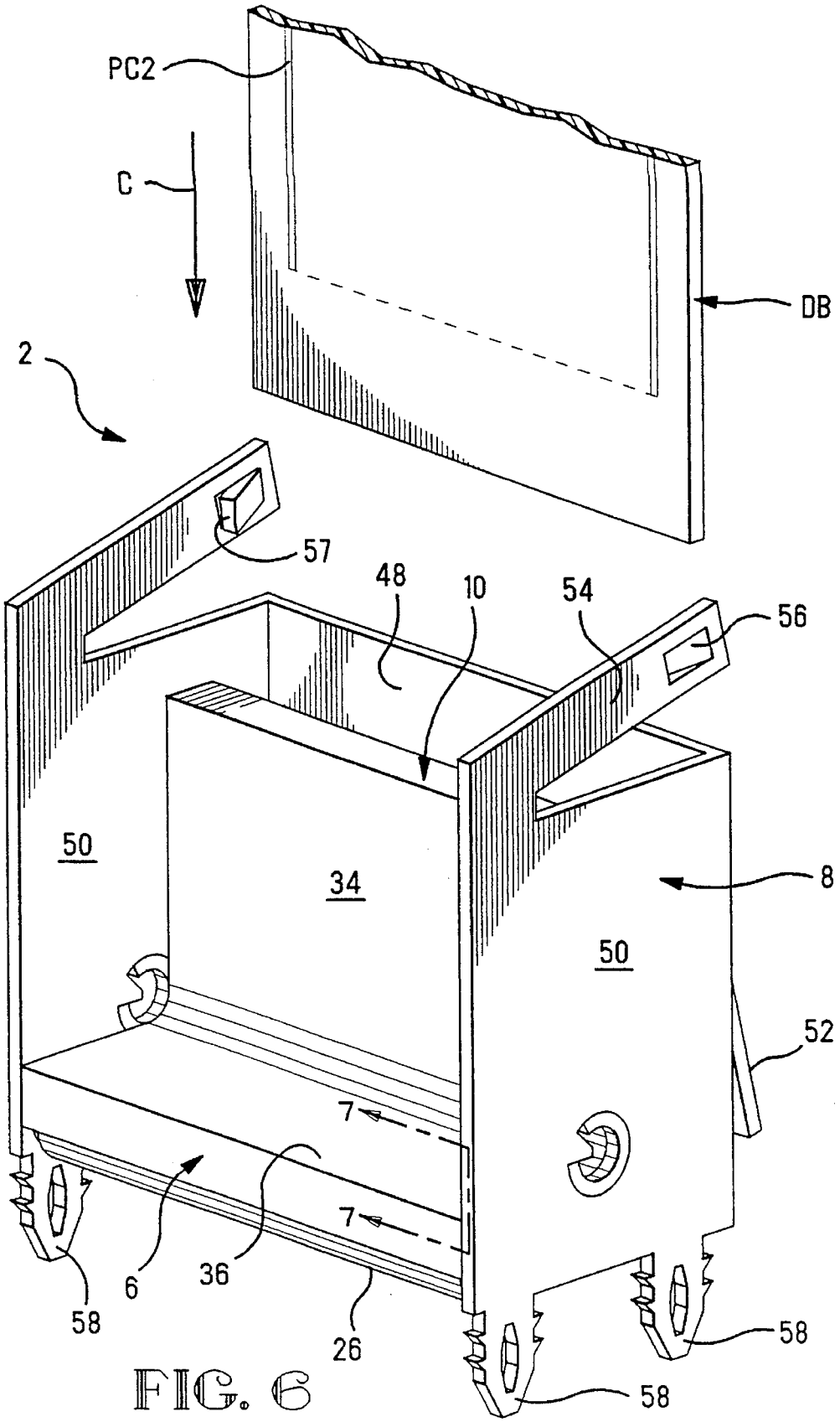
FIG. 6 is a rear isometric view of the mother board to daughter board connector with a daughter board positioned for insertion thereinto.

As best seen in FIG. 5, the housing 8 which has been stamped and formed from a single piece of sheet metal stock, comprises an elongate front plate 48 and opposite, parallel side plates 50 each projecting from a respective end of the plate 48 at right angles thereto. The front plate 48 has a forwardly inclined, bottom, daughter board abutment flap 52 extending along the full length of the plate 48 but being free of the side plates 50. There projects from a top edge 51 of each side plate 50, a forwardly directed and upwardly inclined daughter board locking tab 54 co-planar with the plate 50 and having a struck out daughter board latching tongue 56 projecting obliquely inwardly of the housing 8 and having a free latching end 57. There project from a bottom mounting edge 55 of each side plate 50, two spaced anchoring legs 58 for force fitting into respective holes (not shown) in the mother board MB. Each leg 58 has laterally projecting retention barbs 59 and a central opening 51 to provide lateral resilience. Between each pair of legs 58, and thereabove, is a side plate 50 formed with a circular, through hole 60 from the edge of which projects generally forwardly, an abutment spur 62 having opposed, upper and lower abutment faces 64 and 66, respectively, as best seen in FIG. 7.

Figure 7:
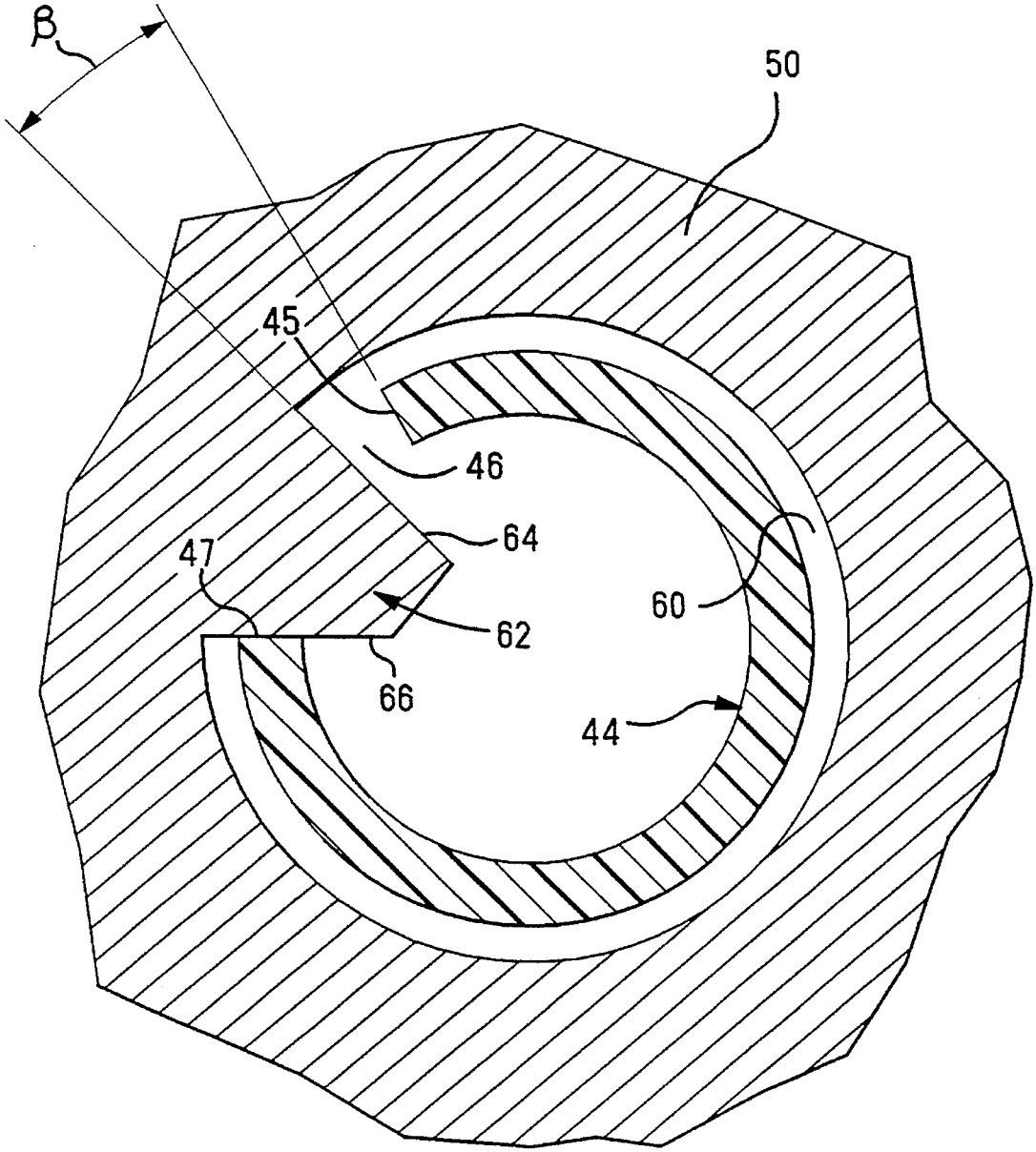
FIG. 7 is an enlarged, fragmentary sectional view taken on the lines 7—7 in FIG. 6.
Figure 8:
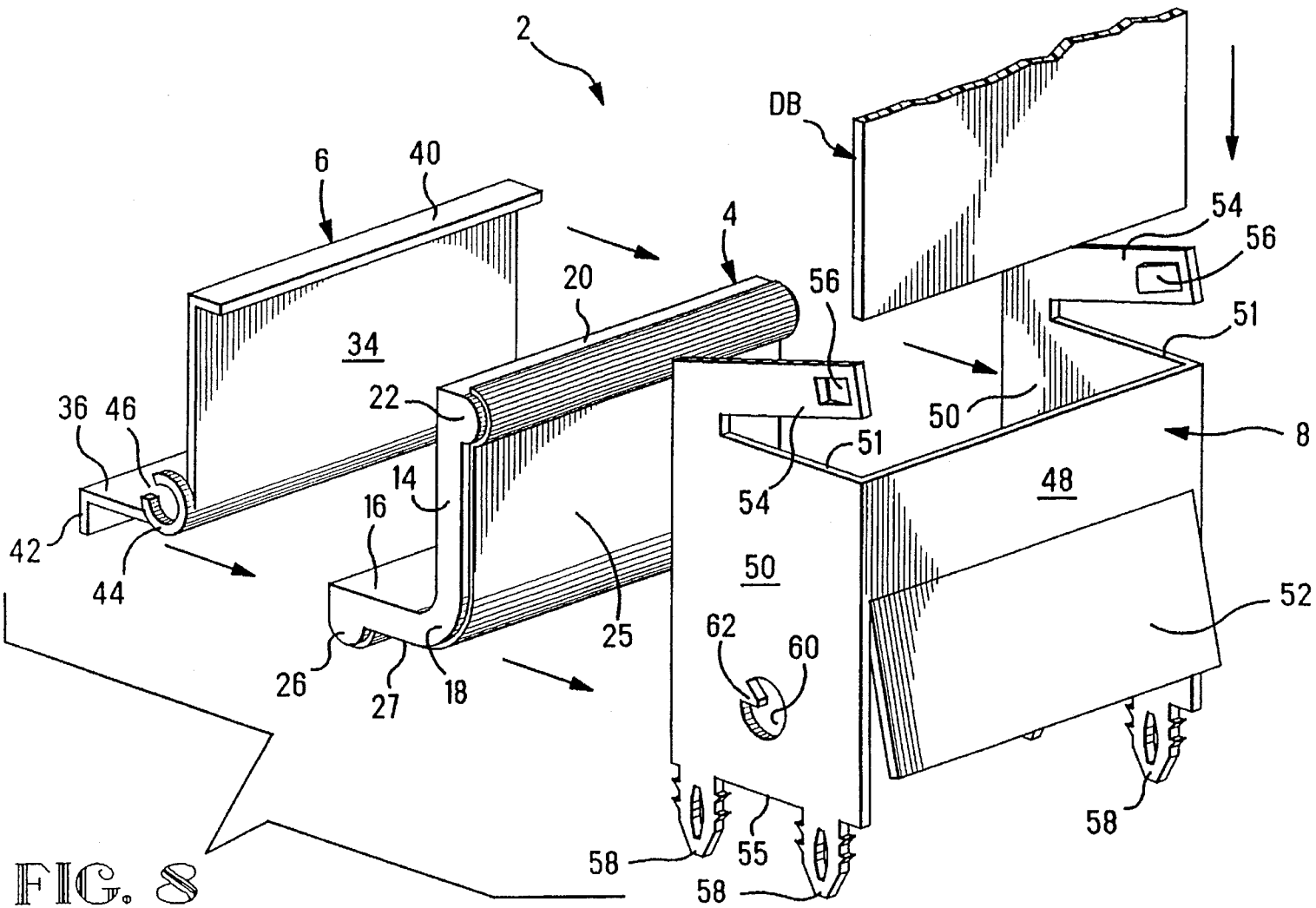
FIG. 8 is an exploded isometric view of the mother board to daughter board connector, the printed conductors of the connector element not being shown.
Figure 9:
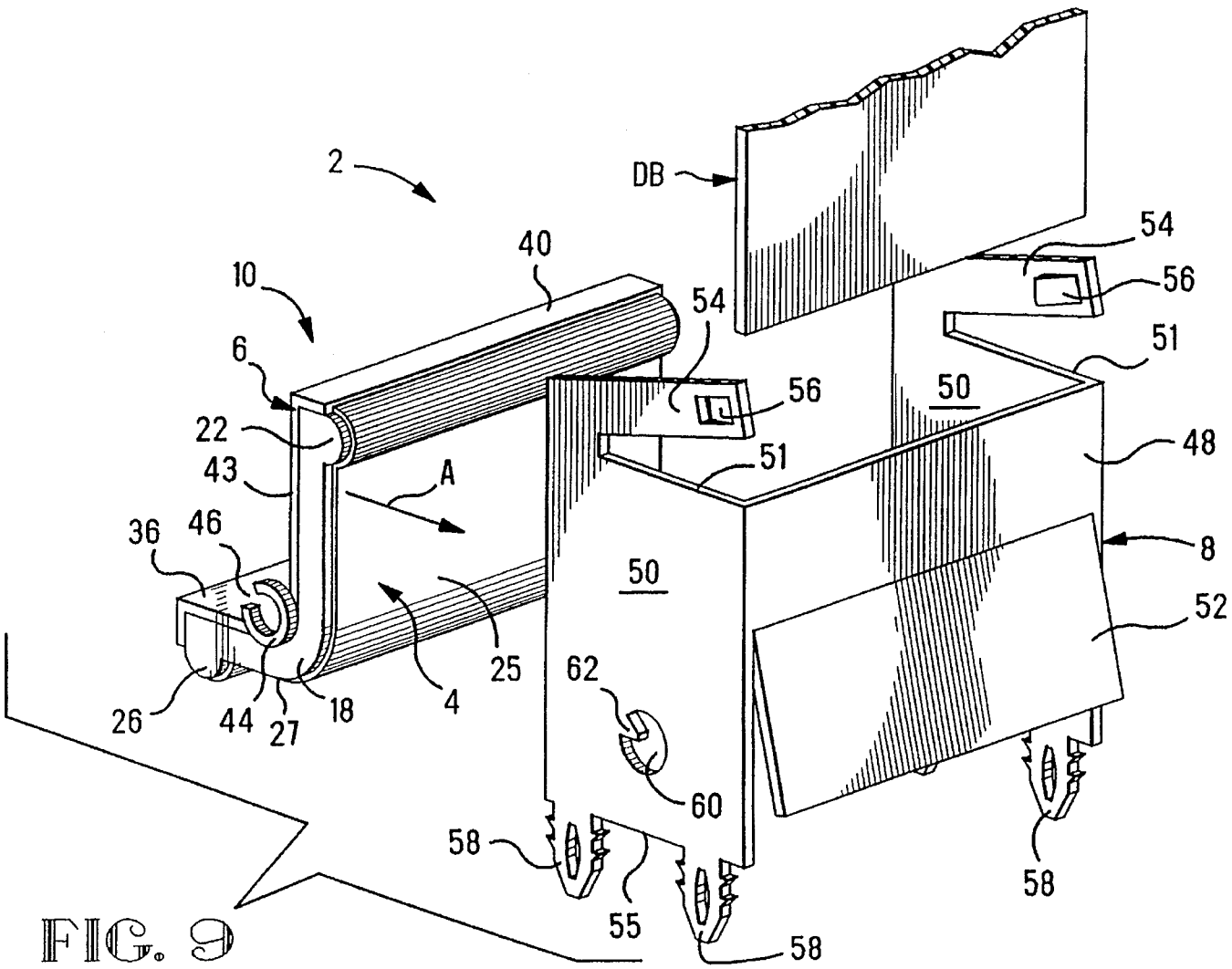
FIG. 9 is a front isometric view illustrating the mounting of the rocker assembly to the metal housing, the printed conductors on the connector element not being shown.

As indicated in FIG. 9, the rocker assembly 10 is mounted to the housing 8 in the direction of the arrow A, with the node 22 leading, so that the assembly 10 is received between the side plates 50, and the resilient trunnions 44 are inserted into respective ones of the holes 60 so that each spur 62 is received in the slot 46 of a respective trunnion 44 as best seen in FIG. 7. When it has been mounted to the housing 8, the rocker assembly 10, can be rocked relative to the housing 8, between a daughter board receiving, a first angular end position (FIG. 10) and a daughter board connecting second angular end position (FIGS. 11 and 12), about the pivots provided by the engagement of the trunnions 44 in the holes 60. In said first angular position, the upright arm 14 and the support plate 34 of the assembly 10 extend in a substantially vertical plane, with the lower edge 47 of each slot 46 engaged against the abutment face 66 of the respective spur 62. In the second angular position of the rocker assembly 10, the upright arm 14 and the support plate 34 are rearwardly inclined with the edge 45 of each slot 46 in engagement with the upper abutment face 64 of the respective spur 62. As shown in FIG. 7, the angular movement of the assembly 10, as determined by the faces 64 and 66 of the spur 62, amounts to about 20°, as indicated by the arrow B in FIG. 7. When assembled, as described above, the mother board to daughter board connector 2 is mounted to the mother board MB (FIG. 12) by press fitting the mounting legs 54 into appropriately positioned holes in the board MB so that the housing 8 is fixed thereto with the mounting edges 55 of the side plates 50 engaging the board MB. Since the downwardly bowed contact surfaces 32 of the conductors 28 normally project slightly below the edges 55, the contact surfaces 32 engage respective conductors PC1 on the board MB when the connector 2 has been mounted thereto.

Figure 12:
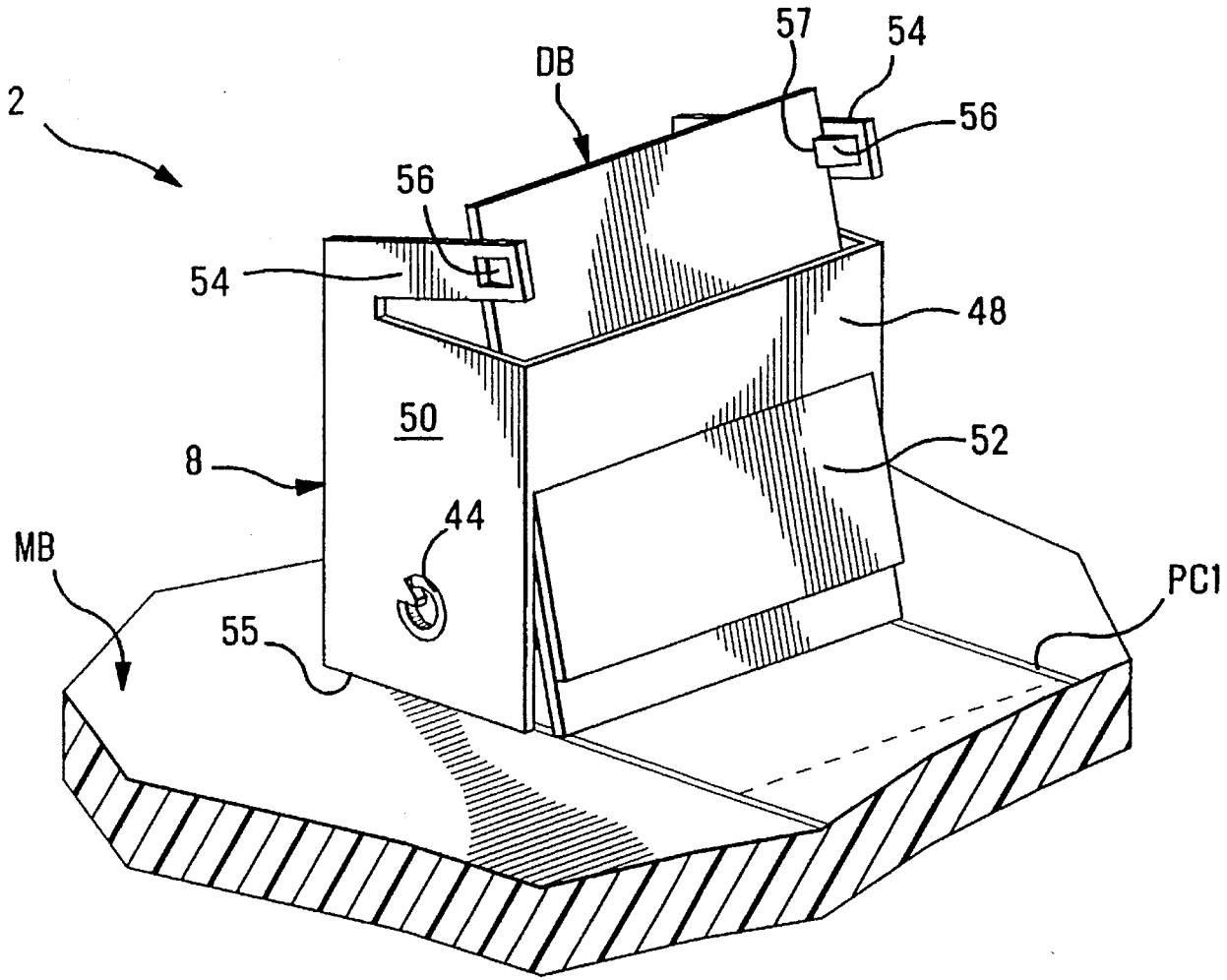
FIG. 12 is a front isometric view showing the mother board-to-daughter board connector mounted on a mother board with the daughter board in its latched, connected position.

The daughter board DB is initially inserted vertically into the connector 2 in the direction indicated by the arrow C in FIG. 6, into a pre-loaded position between the front plate 48 of the housing 8 and the assembly 10, until the leading edge of the daughter board DB bottoms on the mother board MB, the assembly 10 being in its first angular position. As shown in FIG. 10, the board DB is retained in its vertical position, by the engagement of the lateral edges of the board DB against the forward end parts of the latching tongues 56 and by the engagement of the board DB against the front plate 48 of the housing 8. In order to connect each conductor PC2 on the daughter board DB to a respective conductor PC1 on the mother board MB, the board DB is tilted towards the assembly 10, as indicated by the arrows D in FIG. 10, against the resilient action of the latching tongues 56, the tongues 56 being deflected outwardly by the lateral edges of the board DB until the board DB has passed the latching ends 57 thereof so that the tongues 56 resile, whereby the board DB is latched behind the ends 57, in its connecting position, as shown in FIGS. 11 and 12, with the leading end margin of the board DB secured against the inclined abutment flap 52 of the front plate 48 of the housing 8. The board DB is accordingly secured in its connecting position. As the board DB is being tilted, as described above, in the direction indicated by the arrows D, the conductors PC2 on the board DB impinge against the contact surfaces 30 of the conductors 28 of the elastomeric connector element 4, so that the assembly 10 is tilted back against the resilient action of the spring support 6, about the pivots provided by the trunnions 44 and the holes 60. As the assembly is tiled back by the board DB, the plates 34 and 36 and the bight 38 of the spring support 6 are resiliently bent, so that the contact surfaces 30 are spring loaded against the conductors PC2 of the daughter board DB in its latched, connecting position. During the tilting movement of the board DB, the conductors PC2 thereof tangentially engage, and wipe against, the bowed contact surfaces 30, and the bowed contact surfaces 32 of the conductors 28 on the node 26 rotate against, and thus wipe, respective conductors PC1 on the mother board MB, this being allowed by virtue of the resilience of the spring support 6. These wiping actions serve to remove any oxide or other fouling that may be present on the engaging conductive surfaces. The location of the free latching ends 57 of the latching tongues 56 and the angle of the flap 52 are so chosen that in the connected position of the daughter board DB, the conductors PC2 thereof are spring loaded, as described above, against the contact surfaces 30 of the conductors 28.

The board DB can be removed from the connector 2 by releasing the tongues 56 from the board DB by means of a simple tool, for example a screwdriver.

We claim:

1. An electrical connector for interconnecting first conductors on a mother circuit board to respective second conductors on a daughter circuit board, the connector comprising;

an elastomeric connector element having first and second substantially orthogonally projecting nodes and third conductors each having a first contact surface on the first node and a second contact surface on the second node;

and a housing receiving the connector element, the housing having means for securing it to the mother board with the second contact surfaces engaging respective ones of the first conductors, and means for latching the daughter board to the housing in a latched position with the first contact surfaces engaging respective ones of the second conductors;

characterized in that the elastomeric connector element is mounted in the housing on a spring support so as to be rockable against the action thereof by the act of latching the daughter board to the housing, whereby in the latched position of the daughter board the first contact surfaces are spring loaded by said spring support against the second conductors.

2. An electrical connector as claimed in claim 1, in combination with the mother board and the daughter board, characterized in that the housing is secured to the mother board by the securing means, with each second contact surface, which is smoothly arcuate, in tangential engagement with a respective conductor on the mother board, the daughter board being received in the housing in a substantially vertical position, each conductor facing a respective one of the first contact surfaces, which are smoothly arcuate, of the electrical connector element, the daughter board being tiltable from its vertical position, against the connector element to cause it to rock so that each first contact surface wipes against a respective one of the second conductor and each second contact surface wipes against a respective one of the first conductors, until the daughter board has reached its latched position.

3. A connector as claimed in claim 1 or 2, characterized in that the connector element is rockable about pivot means on said spring support, the pivot means comprising part circular spring trunnions each defining a slot in its periphery, each trunnion rotatably engaging in a respective opening in the housing, a spur on the housing protruding into each slot.

4. A connector as claimed in claim 3, characterized in that the spring support has opposite ends from each of which a respective trunnion projects intermediate the first and second nodes of the connector element.

5. A connector as claimed in claim 4, characterized in that the housing has a front plate joining opposite side plates, the connector element and the spring support being of substantially L-shaped cross section and being inter-nested with each other and each having an upright arm and a transverse arm, the first node projecting from the upright arm of the connector element at a position remote from the transverse arm thereof, towards the front plate of the housing and the second node projecting from the transverse arm of the connector element at a position remote from the upright arm thereof and protruding below bottom mounting edges of the housing, for engaging the mother board.

6. A connector as claimed in claim 5, characterized in that the latching means comprise latching tabs projecting forwardly and upwardly from top edges of the side plates, each tab having a latching tongue with a rearwardly directed latching end located back from the front plate, the front plate having a forwardly, and downwardly, inclined bottom abutment flap, for engagement by the daughter board when in its latched position.

7. A connector as claimed in claim 6, characterized in that the latching tabs in cooperation with the inclined flap serve to lock the daughter board in its latched position.

8. A connector as claimed in claim 4, characterized in that each spring trunnion is formed integrally with a respective edge of the spring support.

9. A connector as claimed in claim 4, characterized in that said openings are formed in opposite side plates of the housing, each spur projecting from an edge of said respective opening and having a first abutment face normally engaging one edge of the slot and a second and opposite abutment face normally spaced from the other edge of the slot, for engagement with said other edge in the latched position of the daughter board.

10. A connector as claimed in claim 1, characterized in that the third conductors are printed conductors on the elastomeric material of the elastomeric connector element.

* * * * *